US005872551A

United States Patent [19]

Bancal et al.

[11] Patent Number: 5,872,551

[45] Date of Patent: Feb. 16, 1999

[54] METHOD FOR CONTROLLING A FLAT DISPLAY SCREEN

[75] Inventors: Bernard Bancal, Luynes; Axel Jaeger, Sussargues; Raynald Thevenet, Jacou, all of France

[73] Assignee: Pixtech S.A., Rousset, France

[21] Appl. No.: 660,710

[22] Filed: Jun. 6, 1996

[30] Foreign Application Priority Data

Jun. 8, 1995 [FR] France ..... 75 07017

[51] Int. Cl.[6] ..... G09G 3/22

[52] U.S. Cl. ..... 345/74; 345/208

[58] Field of Search ..... 345/74, 75, 76, 345/78, 211, 213, 84, 204, 208; 315/169.1, 169.3, 349; 313/336, 496, 525

[56] References Cited

U.S. PATENT DOCUMENTS 4,091,411 5/1978 Sanada et al. ..... 358/10
4,366,504 12/1982 Kanatani ..... 358/241
4,459,514 7/1984 Morimoto et al. ..... 345/75
4,940,916 7/1990 Borel et al. ..... 313/306
5,172,108 12/1992 Wakabayashi et al. ..... 340/793
5,532,712 7/1996 Tsuda et al. ..... 345/87
5,565,742 10/1996 Schichao et al. ..... 315/366

*Primary Examiner*—Regina Liang
*Attorney, Agent, or Firm*—Plevy & Associates

[57] ABSTRACT

A method for controlling a cathodoluminescent screen consists of providing regeneration steps during which at least a portion of the anodes is at a low voltage and the corresponding cathodes are biased to an emission state. When the screen is a microtip color screen, regeneration steps are provided between the operation steps and, during the regeneration steps, all the anodes are at a low voltage, the microtips and the gates being biased to an emission state.

12 Claims, 4 Drawing Sheets

METHOD FOR CONTROLLING A FLAT DISPLAY SCREEN

BACKGROUND OF THE INVENTION

1. Field of the Invention

The present invention relates to flat display screens, and more particularly to screens, so-called cathodo-luminescent screens, whose anode supports phosphor elements separated one from another by insulating areas and which can be excited by electronic bombardment. The electronic bombardment requires the phosphors to be biased and can be generated by microtips, low extraction potential layers or a thermo-ionic source.

2. Discussion of the Related Art

To simplify the following description, only color screens including microtips will be described, but it should be remarked that the invention more generally relates to the various above-mentioned types of screens or analog.

FIG. 1 illustrates the structure of a color flat display screen including microtips.

Such microtip screens are mainly constituted by a cathode 1 including microtips 2 and by a gate 3 provided with holes 4 corresponding to the positions of microtips 2. Cathode 1 is disposed so as to face a cathodoluminescent anode 5, formed on a glass substrate 6 that constitutes the screen surface.

The operation and the detailed structure of such a microtip screen are described in U.S. Pat. No. 4,940,916 assigned to Commissariat à l'Energie Atomique.

Cathode 1 is disposed in columns and is constituted, onto a glass substrate 10, of cathode conductors arranged in meshes from a conductive layer. The microtips 2 are disposed onto a resistive layer 11 that is deposited onto the cathode conductors and are disposed inside meshes defined by the cathode conductors. FIG. 1 partially represents the inside of a mesh, without the cathode conductors. Cathode 1 is associated with the gate 3 which is arranged in rows. The intersection of a row of gate 3 with a column of cathode 1 defines a pixel.

The device uses the electric field generated between the cathode 1 and gate 3 so that the electrons are transferred from microtips 2. Thus, the electrons are attracted by phosphor elements 7 of anode 5 if suitably biased. In color screens, the anode 5 is provided with alternate phosphor strips 7*r*, 7*g*, 7*b*, each strip corresponding to a color (red, green, blue). The strips are separated one from the other by an insulating material 8. The phosphors 7 are deposited onto electrodes 9, which are constituted by corresponding strips of a transparent conductive layer such as indium and tin oxide (ITO). The groups of red, green, blue strips are alternatively biased with respect to cathode 1, so that the electrons extracted from the microtips 2 of one pixel of the cathode/gate are alternatively directed toward the facing phosphors 7 of each color.

The selection of the phosphor 7 (phosphor 7*g* in FIG. 1) that must be bombarded by the electrons generated by the microtips 2 of cathode 1 requires a selective control of the biasing of the phosphors 7 of anode 5 for each color.

FIG. 2 schematically illustrates a structure of the anode of a conventional color screen. FIG. 2 is a partial top view near the phosphor elements, representing an anode constructed according to known techniques. The anode strips 9, which are deposited onto substrate 6, are interconnected outside the useful surface of the screen, by color of phosphors 7. Strips 9 are to be connected to a control device (not shown). Two interconnection paths 12 and 13, of the anode electrodes 9*g* and 9*b*, respectively, are formed for two of the three colors of the phosphors (for example 7*g* and 7*b*). An insulating layer 14 (represented in dotted lines in FIG. 2) is deposited on the interconnection path 13. A third interconnection path 15 is connected, through conductors 16 deposited on the insulating layer 14, to the anode electrode strips 9*r* designed for the phosphors 7*r* of the third color.

Generally, the rows of gate 3 are sequentially biased to a voltage of approximately 80 volts whereas the phosphor strips (for example 7*r* and 7*b* in FIG. 1) which should be excited are biased to voltages of approximately 400 volts. The remaining strips (for example 7*r* and 7*b* in FIG. 1) are biased to a low or zero voltage. The columns of cathode 1 are connected to respective voltages ranging from a maximum emission voltage to a non-emission voltage (for example 0 and 30 volts, respectively). The brightness of a color component of all the pixels of a row is so determined.

The selection of the values of the biasing voltages depends upon the characteristics of phosphors 8 and microtips 10. Conventionally, below a voltage difference of 50 volts between the cathode and the gate, there is no electronic emission, and the maximum emission that is used corresponds to a voltage difference of 80 volts.

The conventional method for controlling such a color screen consists of forming several pictures per second, for example 50 to 60 pictures per second, which provides a duration of approximately 20 milliseconds to form each picture. This duration is referred to as frame duration.

As represented in FIG. 3, during a frame duration, three pictures, each corresponding to one color, are sequentially formed, i.e., strips R, G, B are sequentially connected, during the duration of the color subframe Tr, Tg, Tb to high voltages to be selectively active. Conventionally, the color subframes are successively generated without interruption or are separated by very short time intervals during which the rows/columns are inactive.

As represented in FIG. 4, during each color subframe, rows L1 . . . Li−1, Li, Li+1 . . . Ln are sequentially connected to a high voltage so that all the pixels of the corresponding row can be excited at a predetermined time. During the time a row is biased, the column conductors of the cathodes are set to voltages adapted to impart to the corresponding pixels the desired brightness.

A drawback of such a flat display screen occurs when, in at least one picture area, it is desired to display for a relatively long time, ranging from a few seconds to a few minutes, a uniform color corresponding to one of the three primary colors. For this purpose, the corresponding screen portion is biased during only one subframe out of three. Then, it can be remarked that color varies after a short period. This phenomenon is hereinafter referred to as color drift. In practice, this means that at least one of the phosphor strips adjacent to the biased strips starts to be luminescent.

The reason of this phenomenon is not clearly understood. It is thought that this phenomenon is due to the fact that the electrons accumulate in the insulating areas 8 between the phosphor strips and create conduction toward adjacent strips.

To avoid this phenomenon, the prior art has devised various techniques. One technique consists of separating by short time intervals the biasing of the anode strips between two successive color subframes and to apply a negative voltage pulse to the anode that has just been biased before positively biasing the next anode to be excited.

However, this method, which gives satisfactory results for the elimination of the color drift phenomenon, has the drawback of being relatively complex to implement because it complicates the provision of the anode supply voltages, which are high values voltages (some hundred volts). Moreover, the method is detrimental for the screen's brightness.

Also, in monocolor screens, voltage breakdowns often occur when the screen is operated for a long time.

SUMMARY OF THE INVENTION

Thus, an object of the present invention is to provide a new approach to solve the above color drift problem.

Another object of the invention is to provide such a method which also solves the problem of voltage breakdown in color screens or monocolor screens.

To achieve these objects, the present invention is directed to a method for controlling a cathodoluminescent screen consisting of providing regeneration steps during which a portion at least of the anodes is at a low voltage and the corresponding cathodes are biased to an emission state.

According to an embodiment of the invention, the screen is a microtip color screen, the regeneration steps are provided between operation steps and, during the regeneration steps, all the anodes are at a low voltage, the microtips and the gates being biased to an emission state.

According to an embodiment of the invention, the screen is a microtip color screen. Each anode is partitioned into at least two separately addressable portions. The regeneration steps are achieved on a first portion while a picture is being formed in another portion and, during a regeneration step, a first anode portion is at a low voltage and the facing microtips and gates are biased to an emission state.

According to an embodiment of the invention, a regeneration step occurs between each frame.

According to an embodiment of the invention, the duration of a regeneration step is shorter than the duration of a color subframe.

According to an embodiment of the invention, during the regeneration step, the gate rows are sequentially biased, the cathode columns being biased to a high emission voltage.

According to an embodiment of the invention, a plurality of gates are simultaneously biased.

According to an embodiment of the invention, the gates are sequentially biased and are overlapping.

According to an embodiment of the invention, the screen is a monocolor screen.

An advantage of the present invention lies in that, during the regeneration steps, the anodes are at a low voltage and do not attract electrons. Hence, the corresponding phosphors are not excited. Consequently, the regenerated portions of the screen remain dark and do not affect pictures.

Another advantage of the invention is that, as anode-cathode voltage breakdowns are avoided, the anode-cathode voltage can be increased with respect to conventional standards. Therefore, the brightness of the screen is increased.

The foregoing and other objects, features, aspects and advantages of the invention will become apparent from the following detailed description of the present invention when taken in conjunction with the accompanying drawings.

BRIEF DESCRIPTION OF THE DRAWINGS

For the sake of clarity, the figures are not drawn to scale and the same elements are referenced with the same reference characters in the various figures.

The invention provides the insertion of regeneration steps within an image display process.

According to a first embodiment of the invention, during each regeneration step, all the anode strips are set to a low voltage (for not attracting electrons) and the gates (rows) and microtips (cathode columns) are biased under conditions adapted to provide a high, not necessarily maximum, generation of electrons.

The regeneration steps can be provided between two successive frames, between successive subframes, or periodically after a predetermined number of frames.

Because of the conventional configuration of the circuits controlling a color microtip screen, it presently seems to be simpler to generate a regeneration step at the end of each color frame. This will be described hereinafter with reference to a preferred embodiment. However, this description is only by way of example and is not limiting.

In addition, during each regeneration step, because of the structure of the decoding and supply drivers associated with the gate rows and cathode columns, it is in practice impossible to simultaneously supply all the microtips by simultaneously setting all the rows to a high 80 volts voltage and all the cathode to a low voltage close to 0 volt, since the supply power would be insufficient. Thus, preferably, during the regeneration step, all the rows are rapidly sequentially scanned to successively set them, individually or by group, to a high voltage whereas all the cathodes are maintained to a low voltage.

Figure 5:
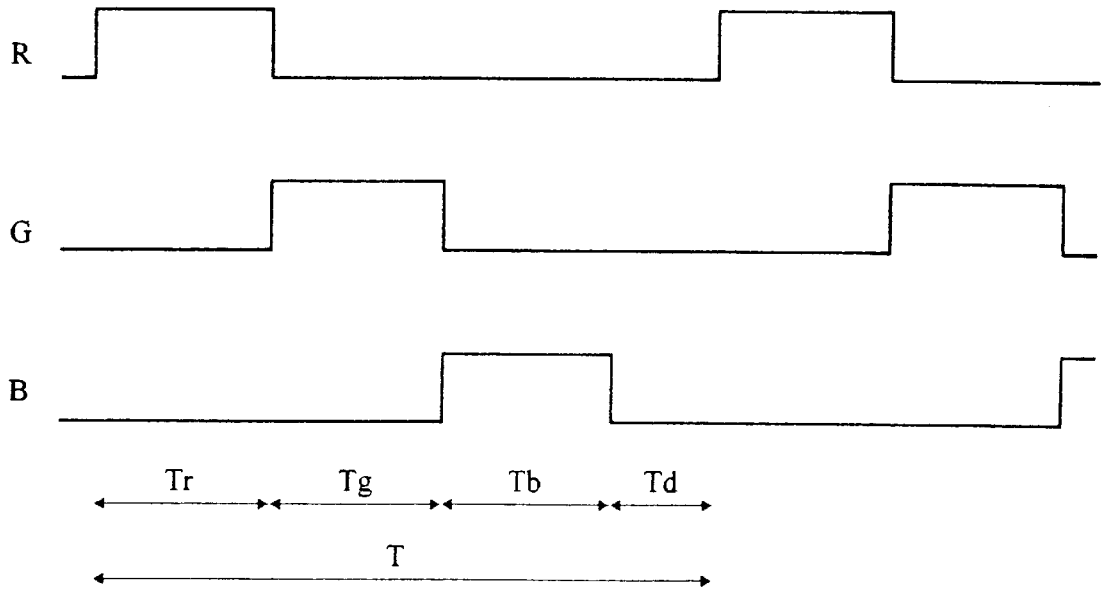
FIG. 5 represents a sequence of color subframes according to a first embodiment of the present invention.

FIG. 5 represents a preferred alternative of a first embodiment for controlling an anode of a microtip color screen according to the present invention.

During a frame duration T, color subframe periods Tr, Tg, Tb are provided as above, during which each strip of a color red, green, blue, is sequentially biased. In addition, a dead time Td, corresponding to a regeneration step, is provided. During time Td, none of the three colors of the anode strips is biased. In contrast, as explained above, the cathode-gate sets are biased to cause electron emission.

Figure 3:
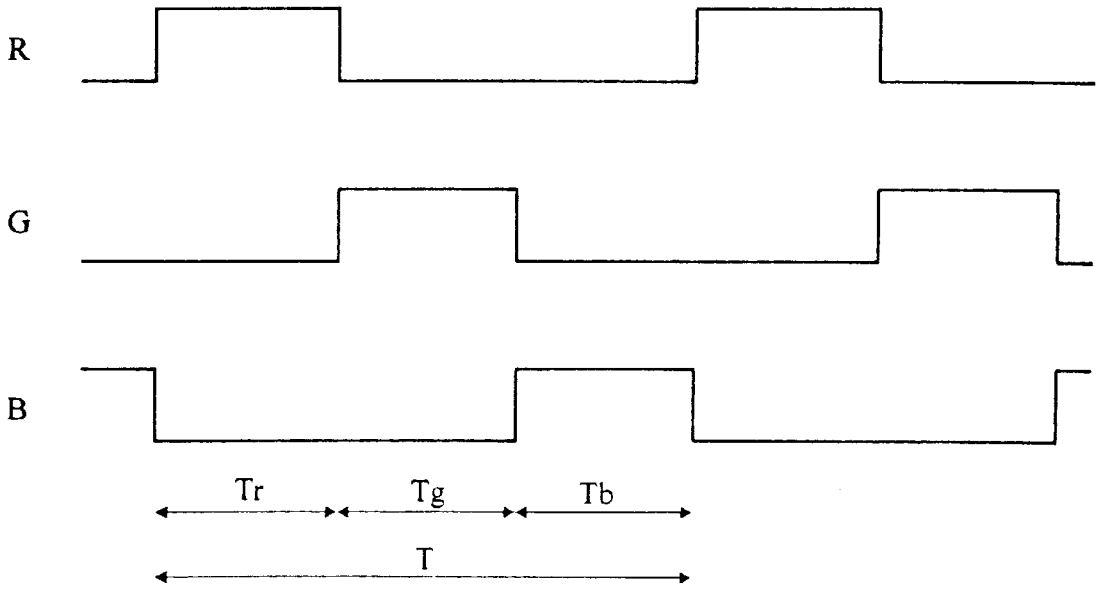
Fig 3 (PRIOR ART)

Period T of FIG. 5 can be identical to period T of FIG. 3, in which case the durations of each subframe Tr, Tg, Tb are reduced. The duration Td is preferably shorter than the duration of each of the periods of the color subframes in order to avoid impairing the brightness of the screen, if the anode-cathode voltage is not increased.

Figure 4:
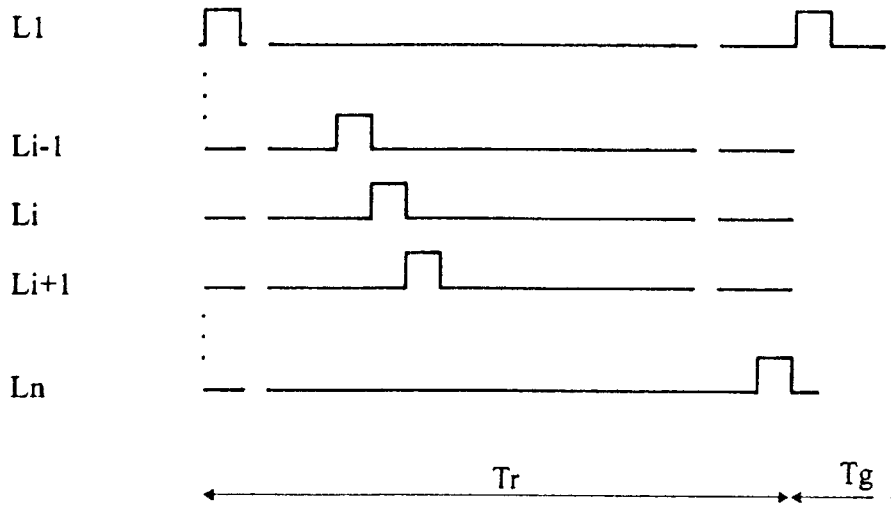
Fig 4 (PRIOR ART)

During a period Td, the gate rows are scanned, as mentioned above, the cathode rows being maintained biased to a high emission voltage. This scanning step can be conventionally achieved as indicated in FIG. 4, each gate being sequentially biased to its high voltage.

Figure 6:
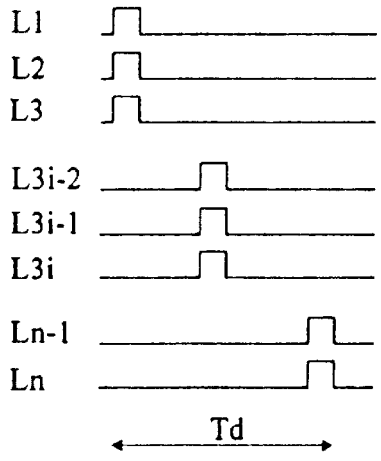
FIGS. 6 and 7 represent two alternatives of sequences of line signals according to the invention that are used during the regeneration steps.
Figure 7:
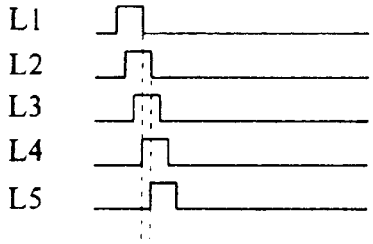

To shorten the scanning of rows, it is possible, as represented in FIG. 6, either to simultaneously set row groups, for example three rows (non necessarily adjacent) to the high voltage, or as represented in FIG. 7, to bias rows in an overlapping way. In FIG. 7, to simplify the drawing, the biased overlapping rows are represented as being adjacent. In practice, other solutions can be used. Of course, in the structures of FIGS. 6 and 7, the number of rows that are biased simultaneously or in an overlapping way is selected so as to remain compatible with the power features of the row and column drivers.

The reason why the present invention solves the problem of the color drift phenomenon is not presently theoretically explained by the inventors. However, experiments made by the inventors on fixed or moving pictures having portions of constant color have proven that the color drift phenomenon is totally eliminated by the present invention.

An advantage of the first embodiment of the present invention is that the desired result is obtained without modifying the design of a device for controlling a microtip screen. It is sufficient to modify the programming of the decoding circuits of the rows, columns and anode strip groups. It should be understood that scanning can be very rapidly achieved and that the dead time can be very short with respect to the frame and color subframe duration.

Figure 1:
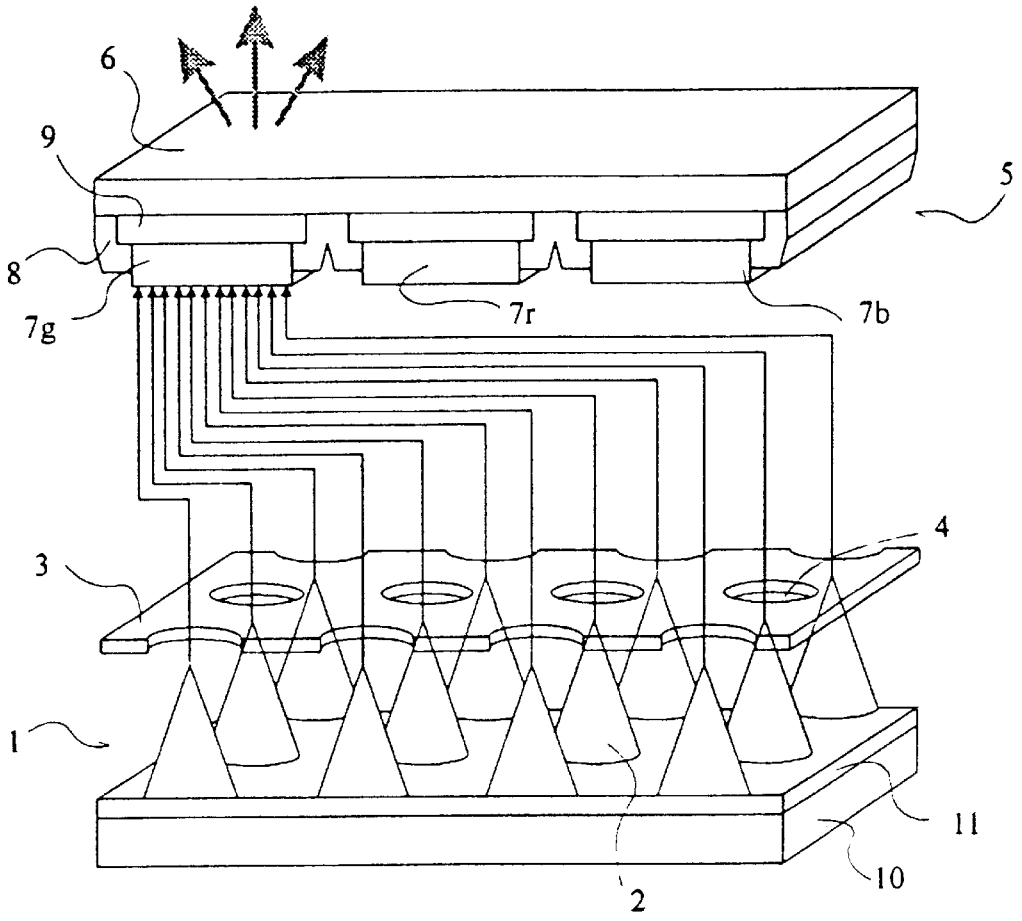
Fig 1 (PRIOR ART)
FIGS. 1–4, above described, explain the state of the art and the problem encountered.
Figure 2:
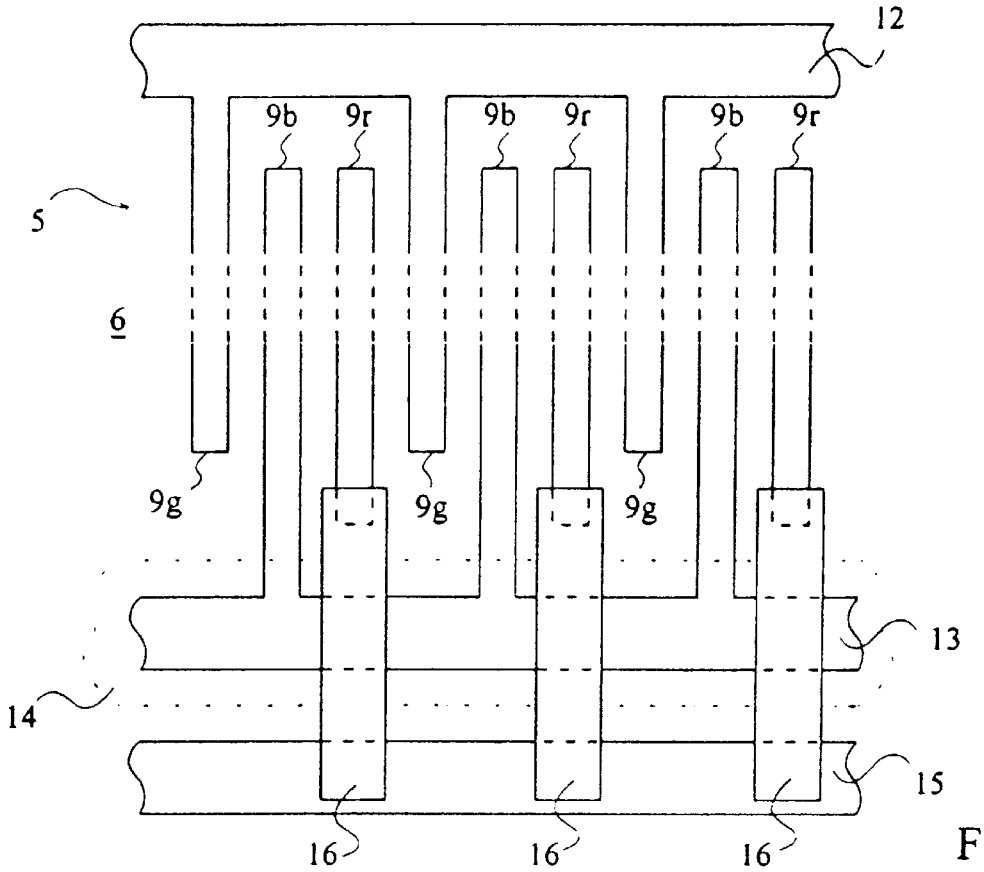
Fig 2 (PRIOR ART)
Figure 8:
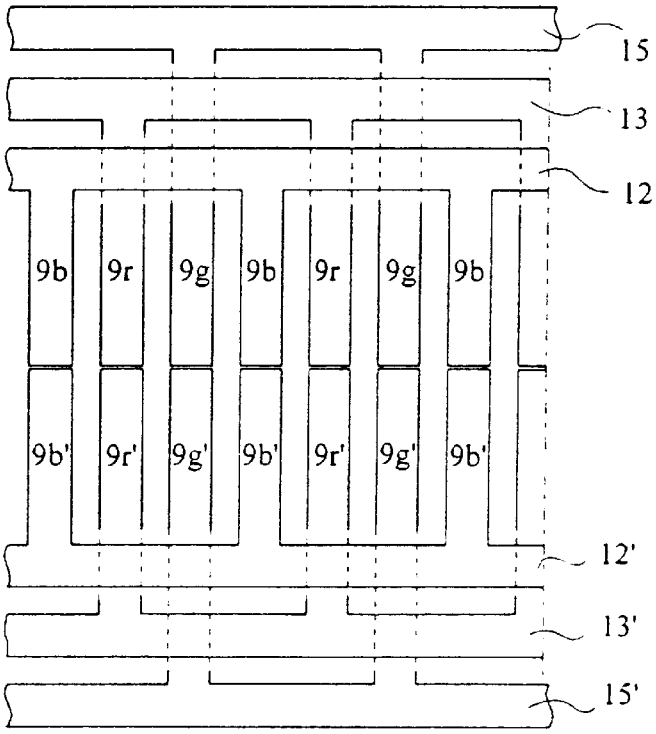
FIG. 8 represents an anode structure adapted for implementing a second embodiment of the present invention.

FIG. 8 illustrates a second embodiment of the invention. In this embodiment, the structure of the anode strips is modified so that each anode strip is partitioned into at least two independently addressable (biasable) portions. In FIG. 8, the same references are used as in FIG. 2. Each anode strip is partitioned into two portions 9*b*-9*b*', 9*r*-9*r*', 9*g*-9*g*'. Portions 9*b*, 9*r*, 9*g* are connected to interconnection paths 12, 13 and 15, respectively. Portions 9*b*', 9*r*' and 9*g*' are connected to interconnection paths 12', 13' and 15', respectively. To simplify, it is assumed that the portions are equal and that the screen is shared into an upper and a lower portion. Thus, whereas the upper rows of the gate are sequentially biased for display, the upper half of the anode is biased (one color), then the lower portion is biased to obtain the desired color subframe. When one half of the screen is addressed for display, a regeneration step is achieved on the second half of the screen as described with relation to the first embodiment of the invention.

An advantage of the second embodiment of the present invention is that the desired result is obtained without dead time with a simple structure modification.

The invention also applies to luminescent screens whose anode voltage is normally fixed. In such screens, it is also possible to provide a regeneration step.

As is apparent to those skilled in the art, various modifications can be made to the present invention. In particular, although the invention has been described in connection with color screen to eliminate the color drift, it has also the advantage of reducing anode-cathode or anode-gate voltage breakdown. So, it also applies to monocolor screen wherein a dead time will be provided between frame displays, for example after each frame.

In an exemplary monocolor screen wherein a frame duration is 10 ms, the anode voltage is 250–300 V and the brightness is 300–400 cd/m$^2$, it is not possible to increase the anode voltage without having voltage breakdowns. According to the invention, a regeneration step of, for example 0,3 ms, is provided at the end of each frame. The inventors have noted that, in such a case, the anode voltage can be increased up to 600 V without having voltage breakdowns. Accordingly, the brightness increased to about 1000 cd/m$^2$.

We claim:

1. A method for controlling a microtip display screen having a plurality of anode strips, a cathode, and a gate, the cathode including a plurality of microtips arranged in columns and the gate arranged as a plurality of gate rows, the method comprising the steps of:

displaying an image having a region of a given color by periodically biasing and scanning each of said plurality of anode strips, the microtips and the gate rows; and regenerating the color of the region by periodically and simultaneously applying to each of said plurality of anode strips only a voltage of sufficiently low potential so as to not attract electrons from said cathode, defining a low voltage, while biasing the microtips and the gate rows to an emission state, the low voltage being selected to avoid the collection of electrons on the on least one anode.

2. The method of claim 1, wherein each of said plurality of anode strips is separately addressable, the step of displaying being achieved on one of said plurality of anode strips, and the step of regenerating being achieved on the other of said plurality of anode strips.

3. The method of claim 1, wherein the step of displaying provides a plurality of successive frames and the step of regenerating is performed between each frame.

4. The method of claim 1, wherein the step of regenerating includes sequentially biasing the gate rows.

5. The method of claim 1, wherein the step of regenerating includes simultaneously biasing the gate rows.

6. The method of claim 1, wherein the step of regenerating includes sequentially biasing the gate rows in a partially overlapping manner.

7. A method for controlling a microtip display screen having a plurality of anodes, a cathode, and a gate, the cathode including a plurality of microtips arranged in columns and the gate arranged as a plurality of gate rows, the method comprising the steps of:

displaying an image having a region of a given color by periodically biasing and scanning each of said plurality of anode strips, the microtips and the gate rows; and regenerating the color of the region by periodically and simultaneously applying to each of said plurality of anodes only a voltage of sufficiently low potential so as to not attract electrons from said cathode, defining a low voltage, while biasing the microtips and the gate rows to an emission state, the low voltage being selected to avoid the collection of electrons on the on least one anode.

8. The method of claim 7, wherein each of said plurality of anodes is separately addressable, the step of displaying being achieved on one of said plurality of anodes, and the step of regenerating being achieved on the other of said plurality of anodes.

9. The method of claim 7, wherein the step of displaying provides a plurality of successive frames and the step of regenerating is performed between each frame.

10. The method of claim 7, wherein the step of regenerating includes sequentially biasing the gate rows.

11. The method of claim 7, wherein the step of regenerating includes simultaneously biasing the gate rows.

12. The method of claim 7, wherein the step of regenerating includes sequentially biasing the gate rows in a partially overlapping manner.

* * * * *